US010311707B2

(12) United States Patent
Halverson

(10) Patent No.: US 10,311,707 B2
(45) Date of Patent: Jun. 4, 2019

(54) INTERACTIVE WIRELESS LIFE SAFETY COMMUNICATIONS SYSTEM

(71) Applicants: Michael Halverson, Laguna Niguel, CA (US); Richard E. Knecht, Newport Beach, CA (US)

(72) Inventor: Michael Halverson, Laguna Niguel, CA (US)

(73) Assignees: Michael Halverson, Laguna Niguel, CA (US); Richard E. Knecht, Newport Beach, CA (US)

( * ) Notice: Subject to any disclaimer, the term of this patent is extended or adjusted under 35 U.S.C. 154(b) by 0 days.

(21) Appl. No.: 15/299,080

(22) Filed: Oct. 20, 2016

(65) Prior Publication Data

US 2017/0039839 A1 Feb. 9, 2017

Related U.S. Application Data

(63) Continuation of application No. 15/058,002, filed on Mar. 1, 2016, now abandoned, which is a (Continued)

(51) Int. Cl.
*G08B 21/00* (2006.01)
*G08B 25/01* (2006.01)
(Continued)

(52) U.S. Cl.
CPC ..... *G08B 25/016* (2013.01); *G08B 21/02* (2013.01); *G08B 21/0446* (2013.01);
(Continued)

(58) Field of Classification Search
CPC .... G08B 21/02; G08B 25/009; G08B 25/014; G08B 25/14; G08B 25/00; G08B 25/016;
(Continued)

(56) References Cited

U.S. PATENT DOCUMENTS 5,534,851 A * 7/1996 Russek ..... A61B 5/0002 340/573.4
7,026,926 B1 4/2006 Walker, III
(Continued)

OTHER PUBLICATIONS

AppShopper, "iAlert Handset", web page <http://appshopper.com/healthcare-fitness/ialert-handset>, Nov. 15, 2016, 2 pages.
(Continued)

*Primary Examiner* — Naomi J Small
(74) *Attorney, Agent, or Firm* — Stetina Brunda Garred and Brucker

(57) ABSTRACT

An interactive wireless life safety communications system is disclosed. A central coordination server is linked to a first network, over which there is a connection to at least one resident life safety device at a specific location or for specific resident. An alarm signal is generated by the resident life safety device upon detection of an alarm condition and transmitted to the central coordination server. A caregiver communications device is connected to the central coordination server over a second network, and is receptive to an alarm notification that is generated by the central coordination server in response to the alarm signal. The caregiver communications device is also receptive to a caregiver user input, from which an action status response is generated for transmission to the central coordination server.

26 Claims, 12 Drawing Sheets

Related U.S. Application Data continuation of application No. 14/468,837, filed on Aug. 26, 2014, now Pat. No. 9,305,450, which is a continuation of application No. 13/611,426, filed on Sep. 12, 2012, now abandoned.

(51) Int. Cl.

| | |
|---|---|
| ***G08B 25/00*** | (2006.01) |
| ***G08B 21/02*** | (2006.01) |
| ***G08B 21/04*** | (2006.01) |
| ***G08B 25/10*** | (2006.01) |
| *G08B 25/14* | (2006.01) |

(52) U.S. Cl.

CPC ..... *G08B 25/00* (2013.01); *G08B 25/009* (2013.01); *G08B 25/014* (2013.01); *G08B 25/10* (2013.01); *G08B 25/14* (2013.01)

(58) Field of Classification Search

CPC .. G08B 21/0446; G08B 25/10; A61B 5/0022; A61B 5/0002

USPC ..... 340/502, 286.06, 431

See application file for complete search history.

(56) References Cited

U.S. PATENT DOCUMENTS

| | | | | |
|---|---|---|---|---|
| 7,348,883 | B2 | 3/2008 | Sloan | |
| 7,606,720 | B1 | 10/2009 | Kerpelman et al. | |
| 8,002,701 | B2 | 8/2011 | John et al. | |
| 8,098,153 | B2 * | 1/2012 | Kraus | G08B 25/016 340/539.18 |
| 2002/0013518 | A1 | 1/2002 | West et al. | |
| 2005/0151640 | A1 * | 7/2005 | Hastings | A61B 5/411 340/539.11 |
| 2007/0073555 | A1 * | 3/2007 | Buist | G06F 19/3481 705/2 |
| 2008/0004904 | A1 * | 1/2008 | Tran | A61B 5/0006 705/2 |
| 2009/0206992 | A1 * | 8/2009 | Giobbi | G06Q 10/10 340/5.74 |
| 2009/0326340 | A1 * | 12/2009 | Wang | A61B 5/746 600/301 |
| 2011/0199214 | A1 * | 8/2011 | Gawlick | A61B 5/0008 340/573.1 |
| 2011/0255670 | A1 * | 10/2011 | Seidberg | G08B 25/08 379/45 |
| 2012/0169467 | A1 * | 7/2012 | Condra | G06F 19/3418 340/8.1 |

OTHER PUBLICATIONS iAlert Appendix, "Version & Release", Dec. 14, 2016, 4 pages.

Syndicated Reviews, "iAlert Handset Review", web page <http://syndicated.reviews/ialert-handset/>, Nov. 15, 2016, 1 page.

* cited by examiner

5/31/2012 12:51:30 PM Retrofit Smoke Detector John may have burned some toast

5/31/2012 12:53:15 PM Retrofit Smoke Detector John may be smoking in his bathroom

5/31/2012 12:55:00 PM Retrofit Smoke Detector Is this smoke detector too sensitive?

5/31/2012 2:19:02 PM Retrofit Smoke Detector This smoke detector is really a problem

5/31/2012 2:20:12 PM 5/31/2012 2:34:15 PM Pendant 1 John Needed help exiting the tub

5/31/2012 2:34:29 PM 5/31/2012 2:47:09 PM Pendant 1 John asked for escort to lunch room

5/31/2012 2:48:00 PM 5/31/2012 2:52:24 PM Pendant 1 He wanted to know if his son was here yet

FIG. 11

INTERACTIVE WIRELESS LIFE SAFETY COMMUNICATIONS SYSTEM

CROSS-REFERENCE TO RELATED APPLICATIONS

The present application is a continuation patent application of U.S. patent application Ser. No. 15/058,002 filed on Mar. 1, 2016, which is a continuation patent application of U.S. patent application Ser. No. 14/468,837 filed on Aug. 26, 2014 now U.S. Pat. No. 9,305,450 issued on Apr. 5, 2016, which is a continuation patent application of U.S. patent application Ser. No. 13/611,426 filed on Sep. 12, 2012, the entire contents of which are incorporated herein by reference.

STATEMENT RE: FEDERALLY SPONSORED RESEARCH/DEVELOPMENT

Not Applicable

BACKGROUND

1. Technical Field

The present disclosure relates generally to remote alert and emergency resident notification systems for assisted, independent, and memory care facilities, and more particularly, to an interactive wireless life safety communications system for caregivers to connect with patients, residents, other caregivers, and staff, and a reporting platform.

2. Related Art

Due to the different levels of disabilities from which an individual can suffer that precludes independent living in one way or another, the degree of care needed to accommodate such individuals and the facilities therefor likewise varies. In general, supervision of or assistance with activities of daily living, including personal hygiene and grooming, dressing and undressing, feeding, bladder and bowel movement, and so forth are provided, as well as provision and/or coordination of healthcare, and monitoring to ensure health, safety, and well-being. At one end of the continuum of care are nursing homes or skilled nursing facilities, which typically accommodate individuals with severe disabilities and require twenty four hour care; while at the other end of the continuum of care is independent living. In between the continuum are assisted living, which helps the elderly and disabled to live active, independent, and dignified lives with maximum personal control while providing for the needs that minimize the exacerbation and effects of chronic conditions.

Assisted living facilities may vary in size from a small residential house to very large, multi-building institutions that care for hundreds of residents. Individual apartment-type units may be assigned to each resident, complete with a bedroom and a bathroom, and possibly other space such as a kitchen or a living area. Alternatively, the residential space may be more akin to a hotel or a dormitory, in which there is a private bedroom (and possibly a private bathroom), with shared common areas including kitchens and living areas. Although skilled nursing staff is not typically on-site at all times throughout the day, other trained staff may be available to accommodate the needs of residents, including housekeeping, laundry, and meal preparation. To the extent registered nurses and licensed practical nurses are unavailable on-site, they may be available by phone.

One of the modalities by which such nurses and medical personnel can be alerted are devices worn by the residents such as pendants and watches. Upon activation by the wearer, or automatically depending on certain conditions, a signal in response to the emergency may be generated for receipt by the staff. Heretofore the preferred notification modality has been one-way numeric or alphanumeric pagers, which utilize a more robust wireless communications technology that ensures timely delivery of messages and minimizes interference with other life-critical equipment. The concern over unreliable wireless communication links is particularly acute in larger, fully enclosed facilities inside of which cellular telephone coverage is weak and unreliable at best. The deployment of pagers in such an environment partially resolved such issues.

However, being one-way devices, the level of interactivity between the pager and staff personnel and the assisted living facility manager(s) was extremely limited. For instance, even though an alert may have been transmitted, there was no way to completely ascertain whether the page was received, and just as importantly, whether any of the staff had responded. Furthermore, even if one of the staff had responded, because there was no way to indicate that such response is ongoing, other staff may also respond and rush to the location of concern. It is possible to include additional information regarding the specific location and the nature of the alert in the page, and it can therefore be expected that the number of responding stuff will be limited to some extent. In many cases, it may be unneeded and hence wasteful of personnel resources, even though it may be desirable for more than one staff member to respond to an alert in some limited circumstances.

For more immediate communications between the alerting system, facility management and the responder, two-way voice radio may be utilized. The limited audio fidelity can render communications difficult, and in any case, may require a full-time dispatcher on the management side. Running and participating in such voice radio nets requires particular knowledge of operation, identification, and priority rules. Another disadvantage with radio is that the loud volume necessary for full comprehension may be disruptive to patients/residents. In more widely dispersed facilities where cellular coverage is not restricted inside buildings because of the relative proximity to the outside, mobile telephones may also be utilized. However, similar problems of delays, additional required staff, and the like are attendant thereto. Moreover, with each additional device that is distributed to personnel, the costs and complexity increase substantially.

Accordingly, there is a need in the art for an improved interactive wireless life safety communications system for caregivers to connect with residents via alerts and voice, caregiver to caregiver and staff, and caregiver to a reporting system. It would be desirable for the communications between the caregivers and other personnel to be bi-directional with voice capability and easily conducted via an intuitive user interface.

BRIEF SUMMARY

The present disclosure contemplates an integrated, interactive wireless life safety communications system, as well as various methods for coordinating life and safety services and staff responses in an assisted care facility. These are envisioned to go beyond conventional one-way notification systems, and provide substantially more interactivity amongst managers and caregiver staff alike for improved response times and efficiency.

One embodiment is directed to a system that includes a first communications network and a second communications network. In various embodiments, the first communications network and the second communications network may be different. There may also be a central coordination server that is linked to the first communications network and the second communications network. Over the first communications network, the central coordination server may be connected to at least one resident life safety device. Such resident life safety device may be associated with one of a specific location within an assisted care facility and a specific resident thereof. An alarm signal is generated by the resident life safety device upon detection of an alarm condition. The alarm signal may be transmitted to the central coordination server when it is generated. Furthermore, there may be at least one caregiver communications device that is associated with a specific caregiver identity and connected to the central coordination server over the second communications network. The caregiver communications device may be receptive to an alarm notification that is generated by the central coordination server. The caregiver communications device may also be receptive to a caregiver user input. An action status response may be generated from the user input, for transmission to the central coordination server over the second communications network.

Another embodiment contemplates a method for coordinating caregiver responses to alert events in the assisted care facility. The method may include generating an alarm signal upon detection of the alert event by a resident life safety device, which may be associated with one of a specific location within the assisted care facility and a specific resident of the same. There may also be a step of transmitting the alarm signal from the resident life safety device to a central coordination server. The resident life safety device may be connected to the central coordination server over a first communications network. The method may include generating an alarm notification on the central coordination server. This can be done in response to a receipt of the alarm signal. There may also be a step of transmitting the alarm notification to at least one caregiver communications device over a second communications network different from the first communications network. Thereafter, there may be a step of receiving a caregiver input on the caregiver communications device. The caregiver input may correspond to an action status response to the received alarm notification. The method may include transmitting the action status response to the central coordination server over the second communications network.

There is another method for coordinating caregiver responses to alert events in an assisted care facility. This method may include receiving an alarm signal on the central coordination server. The alarm signal may be from a resident life safety device associated with one of a specific location within the assisted care facility and a specific resident of the assisted care facility. Moreover, the alarm signal may correspond to the alert event as detected by the resident life safety device. There may also be a step of generating an alarm notification on the central coordination server. The alarm notification may be generated in response to the received alarm signal. The method may include transmitting the alarm notification to at least one caregiver communications device. The method may also include receiving an action status response from a first one of the at least one caregiver communications device. The action status response may be associated with the transmitted alarm notification.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which:

FIG. 11 is an example alert log stored on the central coordination server including received alarm signals, transmitted alert notifications, and received action status responses on the central coordination server.

Common reference numerals are used throughout the drawings and the detailed description to indicate the same elements.

DETAILED DESCRIPTION

Interactive wireless life safety communications systems and methods for coordinating caregiver responses are contemplated by the present disclosure. As part of the system, interactive devices such as tablets, smartphones, and the like are provided to facility staff, who can be alerted and provide responsive status updates via the interactive devices. The detailed description set forth below in connection with the appended drawings is intended as a description of certain embodiments of these systems and the methods, and is not intended to represent the only forms that may be developed or utilized. The description sets forth the various functions in connection with the illustrated embodiments, but it is to be understood, however, that the same or equivalent functions may be accomplished by different embodiments that are also intended to be encompassed within the scope of the present disclosure. It is further understood that the use of relational terms such as first and second and the like are used solely to distinguish one entity from another without necessarily requiring or implying any actual such relationship or order between such entities.

Figure 1:
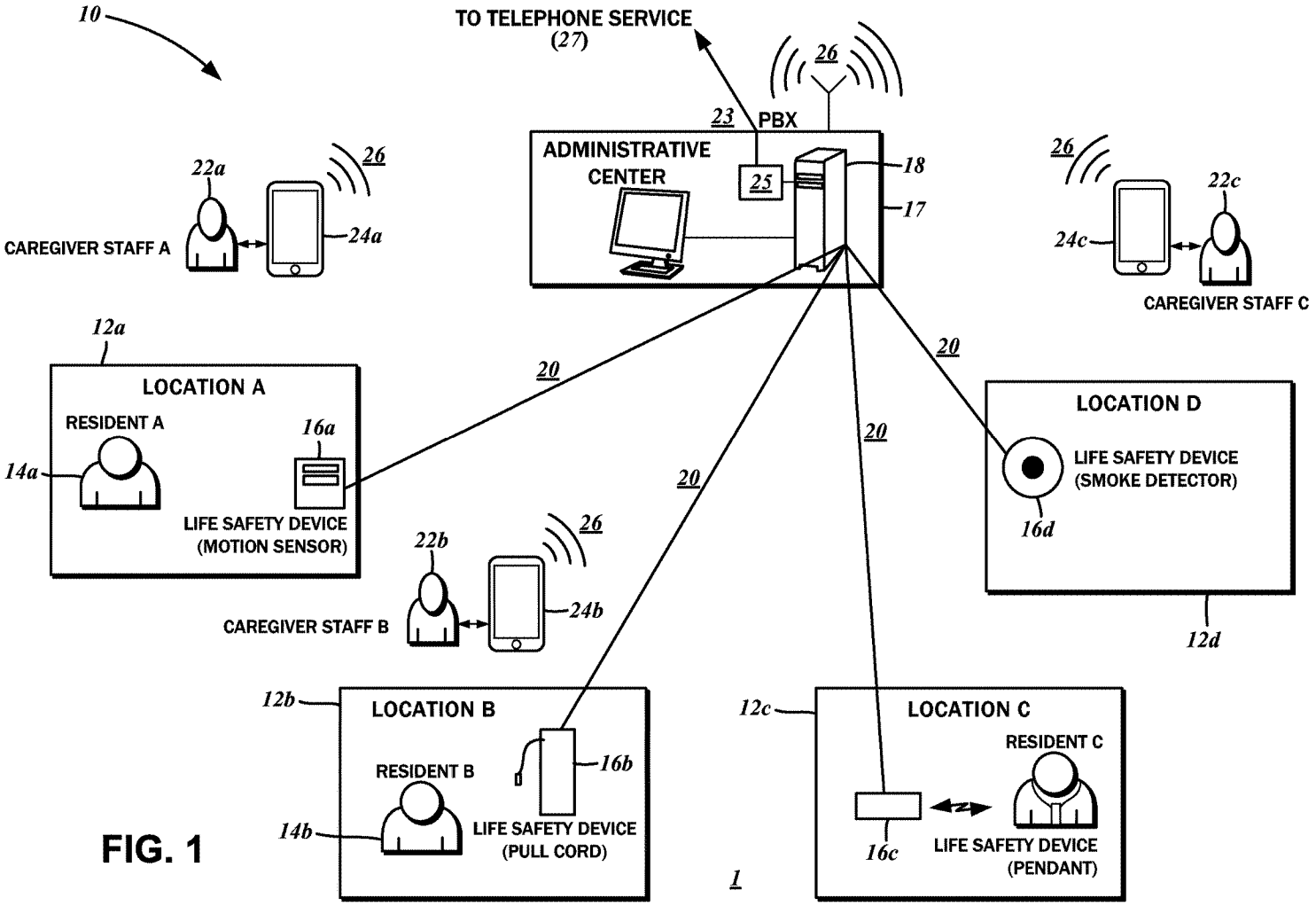
FIG. 1 is a block diagram illustrating the various components of an interactive wireless life safety communications system in accordance with one embodiment of the present disclosure.

With reference to the block diagram of FIG. 1, there is depicted one exemplary embodiment of an interactive wireless life safety communications system 10 that is deployed in an assisted care facility 1. It is understood that assisted living refers to a particular level of care that involves the assistance of elderly and disabled residents with certain life activities and health needs. For the most part, it is not as intensive as nursing homes or skilled nursing facilities, though there is more caregiver involvement than independent living. Notwithstanding the exemplary application of the interactive wireless life safety communications system 10 in such an assisted care facility 1, it is to be understood that such systems and methods of coordinating responses may be applied to any residential facility in which caregiver staff attends to the life and health needs of residents. In this regard, the assisted care facility 1 is referenced by way of example only and not of limitation.

In further detail, the assisted care facility 1 may be separated into various locations 12*a*-12*d*. A first location 12*a* may be a room belonging to a first resident 14*a*. Similarly, a second location 12*b* may be another room belonging to a second resident 14*b*, and a third location 12*c* may be still another room belonging to a third resident 14*c*. A fourth location 12*d* may be another room not necessarily associated with any particular resident. The organization of the locations 12*a*-12*d* is presented as an illustrative example, and is understood to be particular to the assisted care facility 1. For instance, if small buildings/cottages are assigned to residents, then each location 12 may be such a unit, rather than a room. Furthermore, it is to be understood that it is not necessary for only one location 12 to be tied to a specific resident 14; a given residential unit may have multiple sub-sections such as a bedroom, a kitchen, a living room, and so forth, and each such sub-section may also be referred to as one of the locations 12.

The assisted care facility 1 may also include an administrative center 17, from which various activities of the facility may be managed and coordinated. The distance between the administrative center 17 and the different locations 12 may vary, though for the sake of convenience and efficiency, is centrally situated. The specific arrangement of the administrative center 17, of course, depends upon the planning of the assisted care facility 1.

The location 12, then, is understood to be related to a physical area within which a resident life safety device 16 may cover to detect various alarm conditions. An example first resident life safety device 16*a* associated with the first location 12*a* may be a motion detector that triggers an alarm signal upon any motion within the area monitored thereby. The example second resident 14*b* may be confined to a bed, and hence only a pull cord may be installed as a second resident life safety device 16*b*. Alternatively, such as in the case of a wearable pendant, a third resident life safety device 16*c* need not be restricted to a stationary installation to a specific location 12. Also, even without being associated with a particular resident 14, the fourth location 12*d* may include a fourth resident life safety device 16*d* of a smoke detector. Other resident life safety devices 16 are contemplated, including a door alarm, a window alarm, a fall detector, presence detector, a bed pad, a wander bracelet, and an incontinence detector. Indeed, those having ordinary skill in the art will recognize that any suitable life safety device that detects various environmental conditions, personal conditions (i.e., conditions pertaining to the resident 14) and the like may be readily substituted without departing from the scope of the present disclosure.

Each of the resident life safety devices 16 is connected to a central coordination server 18 over a first network 20. As such, the term life safety device 16 is understood to encompass any device that communicates with the central coordination server to signal a condition of a resident or a location within the assisted care facility 1. The aforementioned devices such as the pull cords, non-wander resident pendants and the like are understood to have alerting functions that are activated by the resident 14, and do not necessarily have monitoring functions. Some others, such as the bed pads, presence or motion detectors, fall pads, smoke detectors, incontinence pads and wander bracelets that alert approaches to doors and windows have monitoring as well as alert functions.

Some segments of the first network 20 may be a wired connection suitable for linking permanently installed resident life safety devices 16 such as the bed-side pull cord, a door alarm, and the like. Where necessary, as would be the case for a wearable pendant, the segment of the first network 20 may be wireless. For such devices, there may be several local wireless transceivers that communicate with the pendants at lower power without directly transmitting to/receiving from the central coordination server 18. The wireless signals from the resident life safety device 16 may be relayed to the central coordination server 18 over a segment of the first network 20 that is wired. It will be recognized that there are different modalities by which the resident life safety devices 16 can be connected to the central coordination server 18.

Upon detecting an alarm condition, the respective resident life safety device 16 transmits an alarm signal to the central coordination server 18 over the first network 20. How the alarm condition is detected, and what information is conveyed in the alarm signal, depends on the specifics of the resident life safety device 16. For example, with a pull cord, the corresponding alarm signal may simply indicate the activation of the resident life safety device 16 and the identity of the resident 14 associated therewith. More sophisticated resident life safety devices 16 may incorporate additional data into the alarm signal to convey additional details of the alarm condition to the central coordination server 18.

The central coordination server 18 may be a conventional computer system having various input ports for connecting the resident life safety devices 16. The computer system may be loaded with executable software instructions that generate certain outputs in response to received inputs, including the aforementioned alarm signals from the resident life safety devices 16. Rather than connecting each individual resident life safety device 16 to an input port of the central coordination server 18, there may be an additional routing/switching device that serves as a connection point at the administrative center 17 that aggregates the multiple links to a single or a few connections. Those having ordinary skill in the art will recognize that there are many possible topologies of the first network 20, including shared medium networks that can interconnect related groups of resident life safety devices 16 that would not require additional routing or switching devices.

In accordance with one embodiment of the present disclosure, the central coordination server 18 is a Windows-based personal computer. Management personnel of the assisted care facility may access a software application that shows real-time operational status updates of the interactive wireless life safety communications system 10. Such access may be direct, that is, the user interface to the software application is presented on a display device connected to the computer, and it is possible for personnel to navigate various options of the software application using input devices also connected to the computer. Alternatively, it is also possible for the central coordination server 18 to lack a display monitor, keyboard, mouse, and other peripheral devices typical of a personal computer. Instead, management personnel can log in to the central coordination server 18 via a remote terminal that emulates the user interface to the software application. Management of the interactive wireless life safety communications system 10, vis-à-vis the central coordination server 18 and the software application running thereon, will be discussed in further detail below.

The assisted care facility 1 also employs many caregiver staff 22, including, for example, a first caregiver staff 22*a*, a second staff caregiver 22*b*, and the third caregiver staff 22*c*, to attend to the needs and emergencies of the residents 14. In accordance with various embodiments of the present disclosure, each of the caregiver staff 22 is assigned a communications device 24. These caregiver staff 22 may have varying skillsets and specialties such as nursing, emergency medical, custodial, food preparation/delivery, and so forth that are well-suited for assisting the residents 14.

Assigned to each of the caregiver staff 22 is a caregiver communications device 24. One of the embodiments of the assisted care facility 1 contemplates the caregiver communications device 24 being a tablet computer. In this regard, such tablet computer may include a touch display screen through which its user can interact with a graphical user interface to another software application running thereon. Additionally, the tablet computer may include a conventional short-range data communications modality such as WiFi, via which data communications links to the central coordination server 18 may be established. Although the example caregiver communications device 24 is described as a tablet computer, any other suitable multi-function device such as smart phones that are capable of running the same or similar software applications and having wireless networking features may be substituted without departing from the scope of the present disclosure.

The interactive wireless life safety communications system 10 therefore contemplates a second network 26, which is understood to be different from the first network 20 interconnecting the various resident life safety devices 16 to the central coordination server 18. There are various ways in which the second network 26 can be deployed in the assisted care facility 1, including the installation of base stations, antennas, and the like. Along these lines, it is not necessary of the second network 26 to be WiFi, and any other suitable short to medium range data communications modality may be utilized. Those having ordinary skill in the art will recognize the appropriate configuration of the central coordination server 18, the caregiver communications device 24, and other connectivity devices to accommodate such an alternative network.

The caregiver communications device 24 is envisioned to provide substantially more information to caregiver staff 22 over conventional notification devices utilized in the life safety and assisted care field such as pagers and two-way radios. Thus, according to one embodiment, the caregiver communications device 24 is receptive to an alarm notification that is generated by the central coordination server 18 in response to a received alarm signal from the resident life safety device 16. Furthermore, because of its interactivity, caregiver staff 22 can provide feedback and updates to administrators via the central coordination server 18. That is, an action status response may be generated at the command of the caregiver staff 22 for transmission to the central coordination server 18 over the second network 26.

Figure 2:
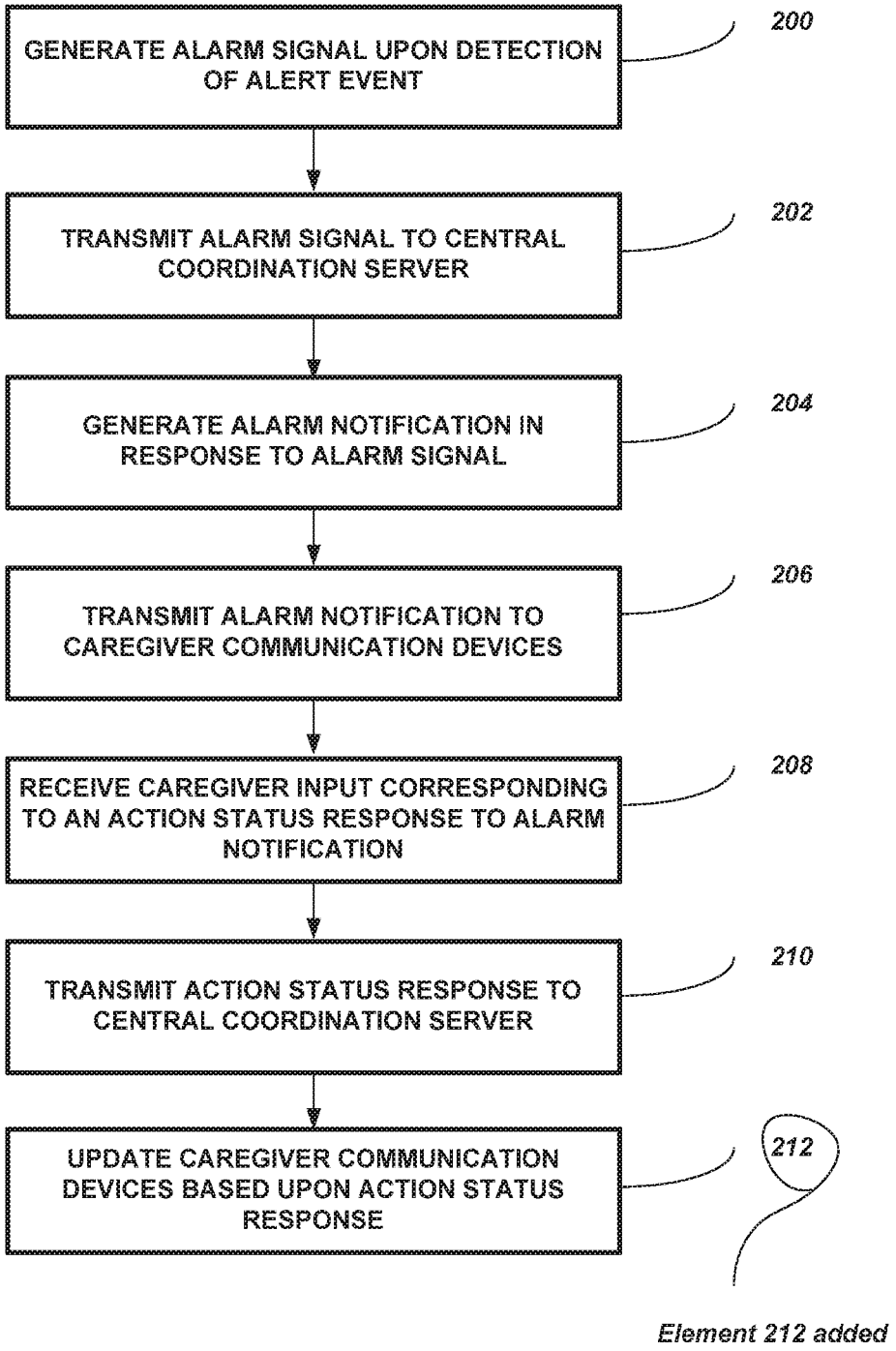
FIG. 2 is a flowchart of one exemplary method for coordinating caregiver response to an alert event.
Figure 3:
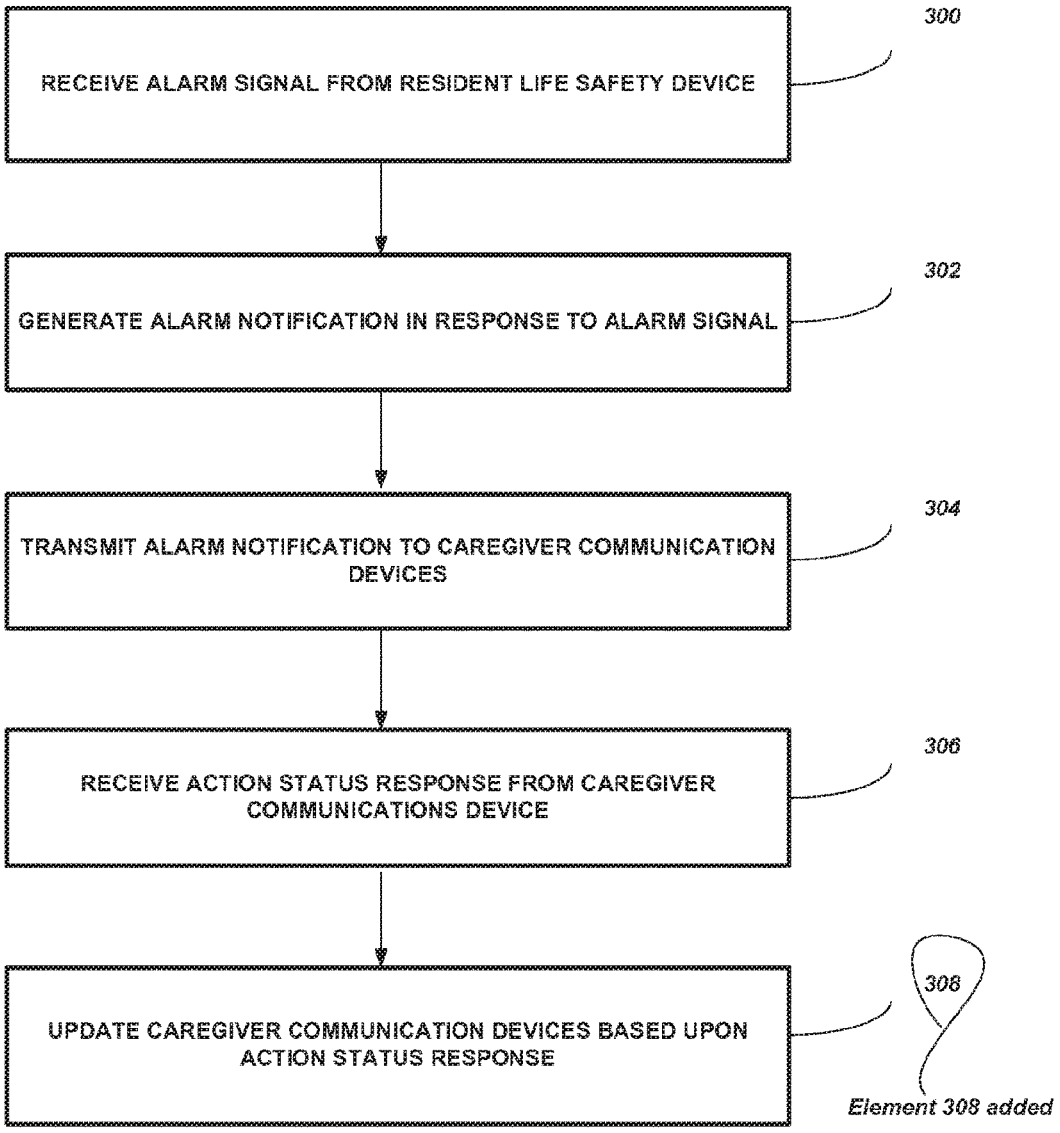
FIG. 3 is a flowchart of another embodiment of the method for coordinating caregiver response to an alert event as performed by a central coordination server.

Having considered the various components of the interactive wireless life safety communications system 10 on a broad level, additional details thereof will be discussed in the context of several contemplated methods of coordinating the responses of the caregiver staff 22. Referring now to the flowchart of FIG. 2, the method begins with a step 200 of generating the alarm signal. As indicated above, the alarm signal is generated by the resident life safety device 16 upon detection of an alarm event. For example, in the case of the smoke detector or fourth resident life safety device 16*d*, when a sufficient level of smoke is detected within the fourth location 12*d*, then the alarm is triggered, and the alarm signal is generated thereby. The content of the alarm signal includes data that it originates from the resident life safety device 16*d*, and may include a descriptor that it represents the smoke detector. Although per the example above, the fourth location 16*d* is not associated with a particular resident 14, for a resident life safety device 16 that is, the corresponding alarm signal generated may also include an identifier therefor.

Next, in accordance with step 202, the method continues with transmitting the alarm signal from the resident life safety device 16 to the central coordination server 18. Again, the resident life safety device 16 is linked to the central coordination server 18 over the first network 20.

Another embodiment of the present disclosure contemplates a method for the administrative center 17 to coordinate the responses of the caregiver staff 22. The aforementioned step 202 of transmitting the alarm signal to the central coordination server 18 has a corollary step 300 of receiving the same alarm signal from the resident life safety device 16.

Both methods involve a step 204, and 302, respectively, of generating an alarm notification on the central coordination server 18 in response to the received alarm signal. Moreover, both methods also include a step 206, and 304, respectively, of transmitting the alarm notification to the caregiver communications devices 24 over the second network 26.

Figure 4:
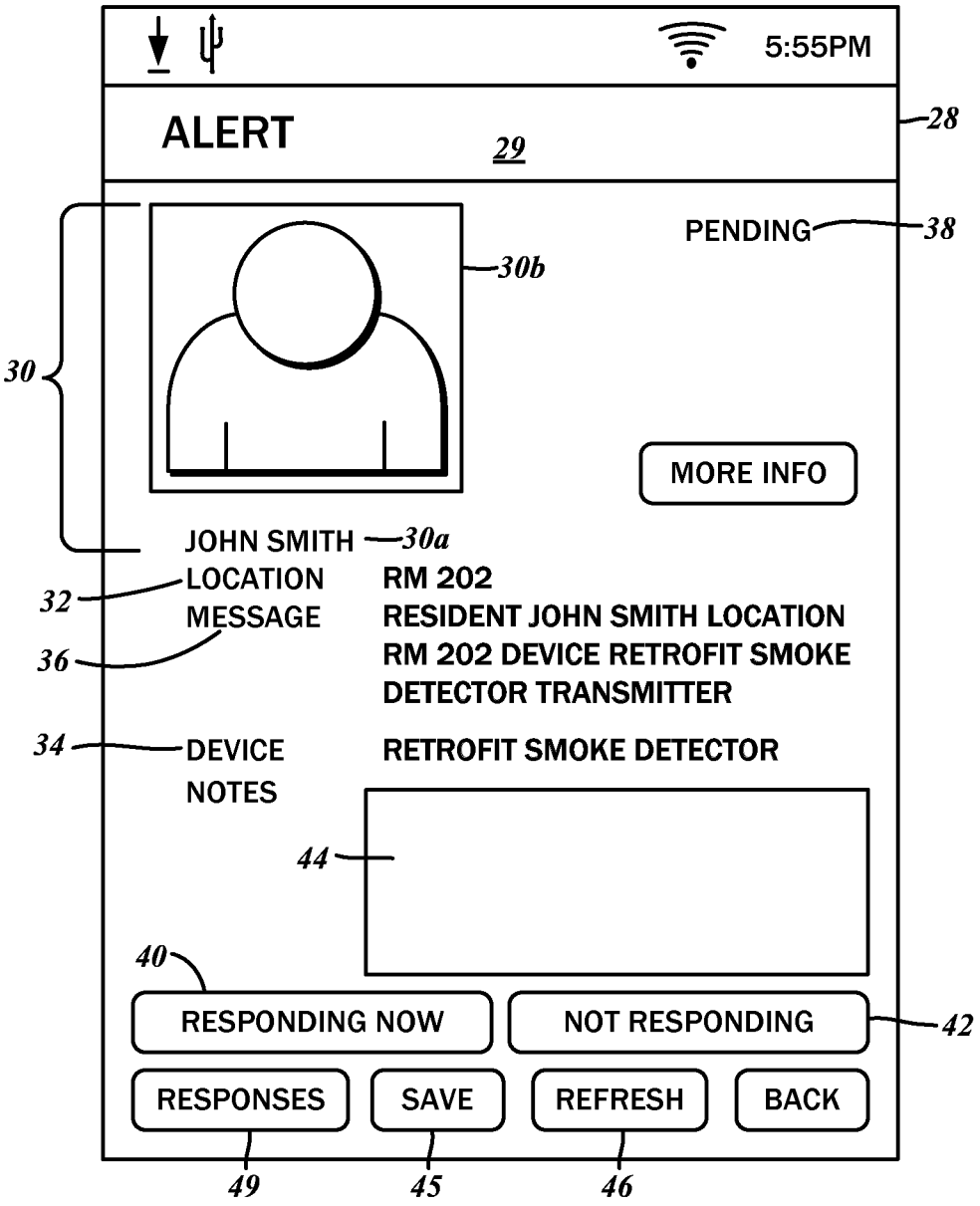
FIG. 4 is a screen capture of a user interface generated on a caregiver communications device, the user interface showing an alert notification.

As best shown in the screen capture of FIG. 4, the alarm notification is displayed as a notification screen 29 in a user interface 28 that is generated on the caregiver communications device 24. In further detail, to the extent the alarm notification includes a resident identifier 30, comprised of a resident name 30*a* (e.g., John Smith), as well as a graphical representation or photograph 30*b* of the resident 14. The photograph of the resident 14 is understood to be helpful for new or temporary caregiver staff 22 who may not yet have established a personal relationship with the resident 14. Additionally, there is a location identifier 32 that corresponds to the location 12 for which the alarm notification pertains, and a life safety device identifier 34 that corresponds to the specific resident life safety device 16 from which the alarm notification originated. Although the notification screen 29 renders the resident identifier 30, the location identifier 32, and the life safety device identifier 34 into appropriate sections thereof, there is also a message section 36 that concisely displays these identifiers.

Other modalities for visualizing the alarm notifications on the caregiver communications device 24 are also contemplated. These include overlaying the alert notifications on a site map of the assisted care facility 1, in accordance with the location information included therein. For resident life safety devices 16 that can be arbitrarily located within the assisted care facility 1 such as locator pendants worn by the resident 14, GPS or other coordinate data may be incorporated, and used to display the alert notifications.

An alert status indicator 38 shows that the alert notification is pending. Other statuses such as cleared, when another caregiver staff 22 has responded to the alert notification, may also be shown as the alert status indicator 38. Upon receipt of the alert notification, in addition to showing the alert status indicator, the caregiver communications device 24 generates an audible alert, as well as a vibration output.

As noted above, the caregiver communications device 24 is contemplated to be interactive, in that the caregiver staff 22 provides inputs that, in turn, generate responses that are passed to the central coordination server 18. These responses are also referred to as an action status response. Referring again to the flowchart of FIG. 2, the method for coordinating caregiver responses continues with a step 208 of receiving caregiver input that corresponds to the action status response. The notification screen 29 includes a responding action status button 40, as well as a declining action status button 42. It is understood that the caregiver staff 22 presses the responding action status button 40 when, upon viewing the alert notification, is willing and able to respond to it. By activating the responding action status button 40, the caregiver staff 22 is communicating to the administrative center 17 as well as to other caregiver staff 22 that he or she is responding. Otherwise, the caregiver staff 22 presses the declining action status button 42, effectively indicating to other staff that he or she is not available.

Figure 5C:
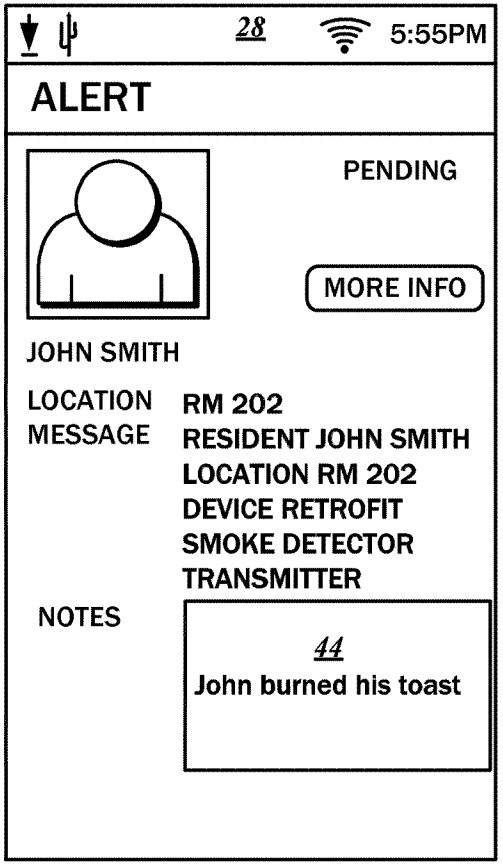
FIGS. 5A-5C are screen captures of the user interface showing input modalities for providing the action status response.
Figure 5B:
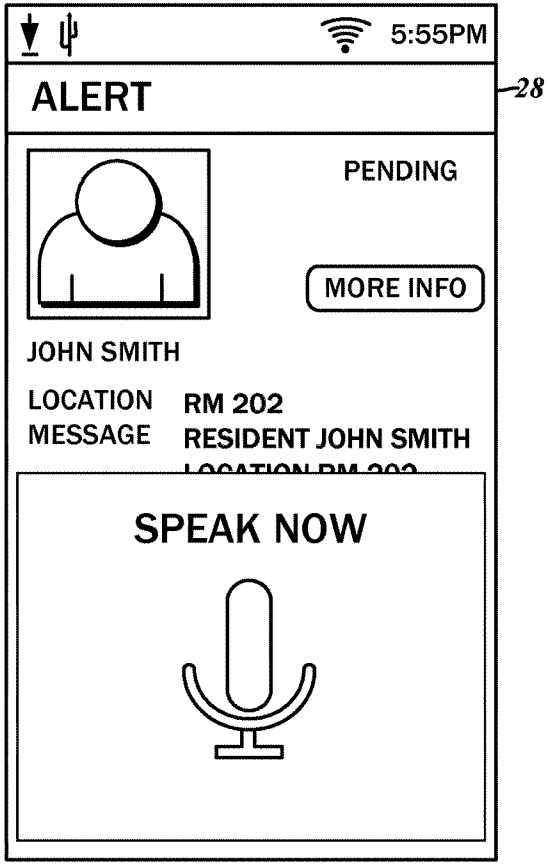
Figure 5A:
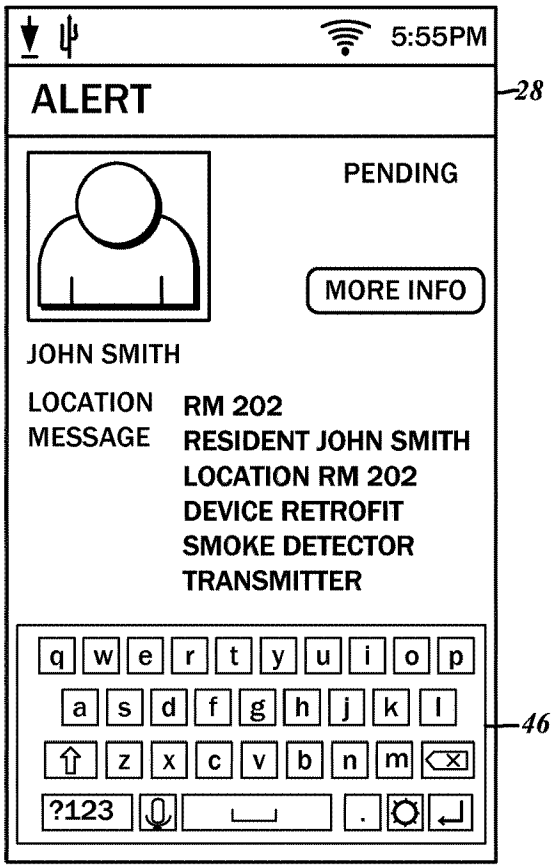
Figure 6:
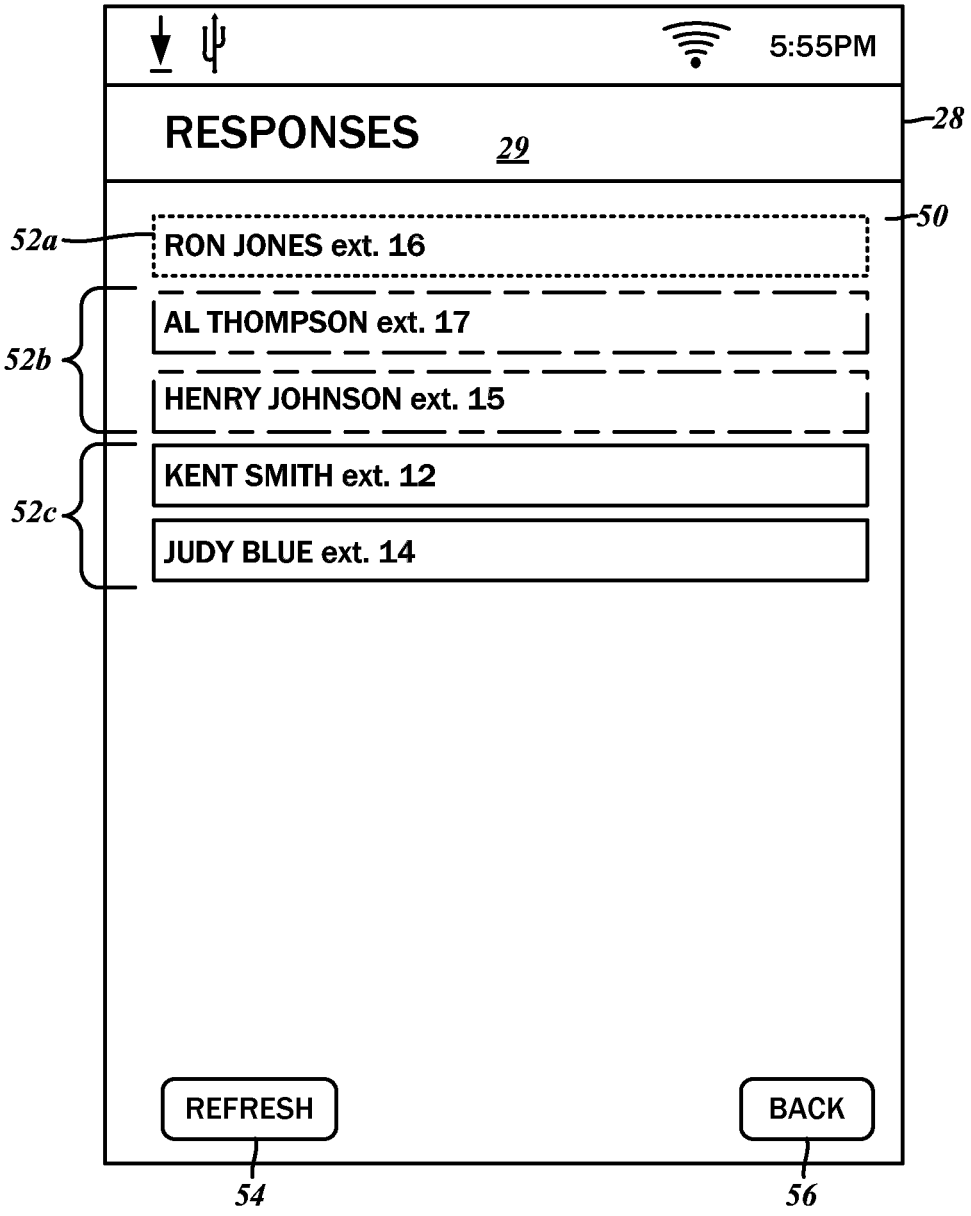
FIG. 6 is a screen capture of the user interface showing a summary of action status responses from other caregiver communications devices.

When responding, it is possible for the caregiver staff 22 to include additional information in a text input box 44. As best shown in the screen captures of FIGS. 5A-5C, when the text input box 44 is selected, in accordance with conventional touch input interfaces, a virtual keyboard 46 may be overlaid on the user interface 28 to accept text input. Alternatively, as particularly shown in FIG. 5B, a microphone on the caregiver communications device 24 may be activated to receive dictation from the caregiver staff 22. An icon 48 representative of the capacity to accept sound input is displayed. Upon completion of input, the software application may process the received audio data and convert the same to text data in accordance with one of many known voice recognition algorithms and software implementations thereof. Whether by text input or by voice input, the received information is rendered within the text input box 44, as best illustrated in FIG. 5C. Referring back to FIG. 4, without fully responding by activating either the responding action status button 40 or the declining action status button 42, the information entered into the text input box 44 may be saved after activating a save button 45. Beyond text data, pictures, videos, and other multimedia content may be recorded on the caregiver communications device 24 that can be appended to the action status response.

Either with additional information entered into the text input box 44 or without, activating the responding action status button 40 or the declining action status button 42 is operative to transmit the action status response to the central coordination server 18. This is understood to be a step 210 in the method for coordinating caregiver staff 22 responses to the alarm events Like the alarm notification, the action status response is transmitted over the second network 26. In the method for the administrative center 17 to coordinate the responses of the caregiver staff 22, there is understood to be a corollary step 306 of receiving the action status response from the caregiver communications device 24. Such updates may be further propagated to the other caregiver communications devices 24 connected to the central coordination server 18. This is understood to be a step 212, and 308, respectively, of updating caregiver communications devices based upon an action status response.

In some embodiments, the caregiver communications devices 24 are in constant communication with the central coordination server 18. As such, whenever the details of the alarm notification changes (e.g., another caregiver indicates that he or she is responding, or additional information has been provided) the notification screen 29 is updated automatically. In order to conserve bandwidth and battery power, it is possible to refresh the notification screen 29 only periodically. Whenever updated information is desired, however, a refresh button 46 may be pressed, which is operative to poll the central coordination server 18.

The notification screen 29 further includes another button 49, which invokes a response details screen 50 that is displayed in the user interface 28. Each of the caregiver staff 22 are listed therein, along with an identifier of the caregiver communications device 24. Highlighted in a first color (e.g., green) is the one caregiver staff 52*a* who has indicated, via the action status response, that he/she is responding to the alert notification. Those caregiver staff 52*b* who have not yet responded are highlighted in a second color (e.g., yellow), while those caregiver staff 52*c* who declined the alert notification are highlighted in a third color (e.g., red). Again, while in some embodiments the listing in the response details interface 50 may be constantly refreshed, while in others, only periodic download of the data from the central coordination server 18 may occur. For the latter, there is provided a refresh button 54 that, when selected, polls the central coordination server 18 for the most updated response information. The selection of a back button 56 returns the user interface 28 to the notification screen 29.

Figure 7A:
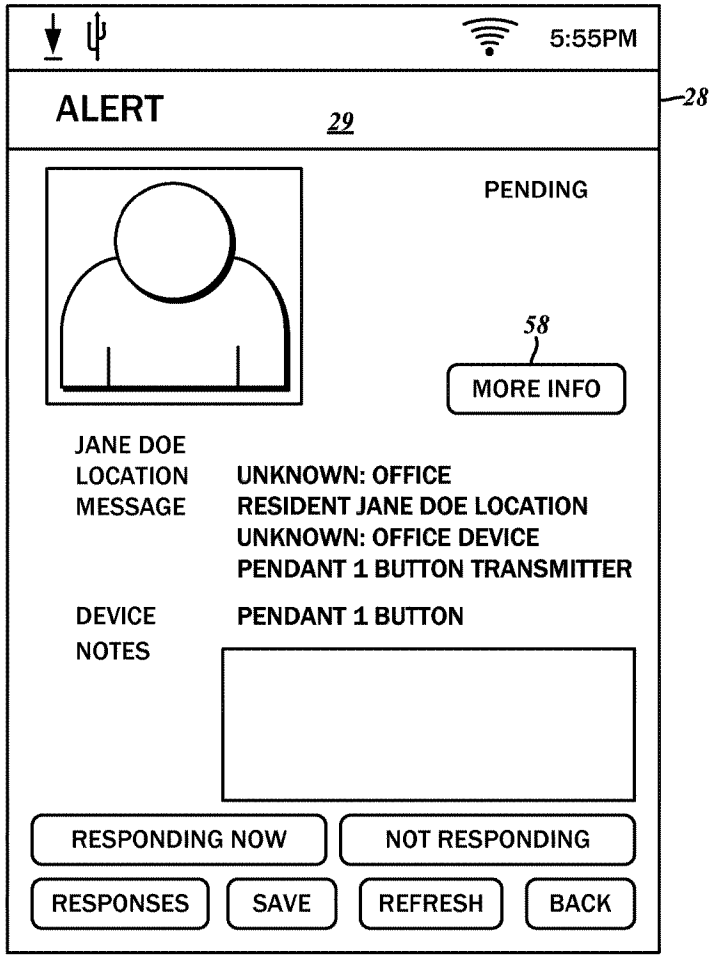
FIG. 7A-7D are screen captures of the user interface showing an action status response in which additional assistance from other caregiver staff is being requested.
Figure 7B:
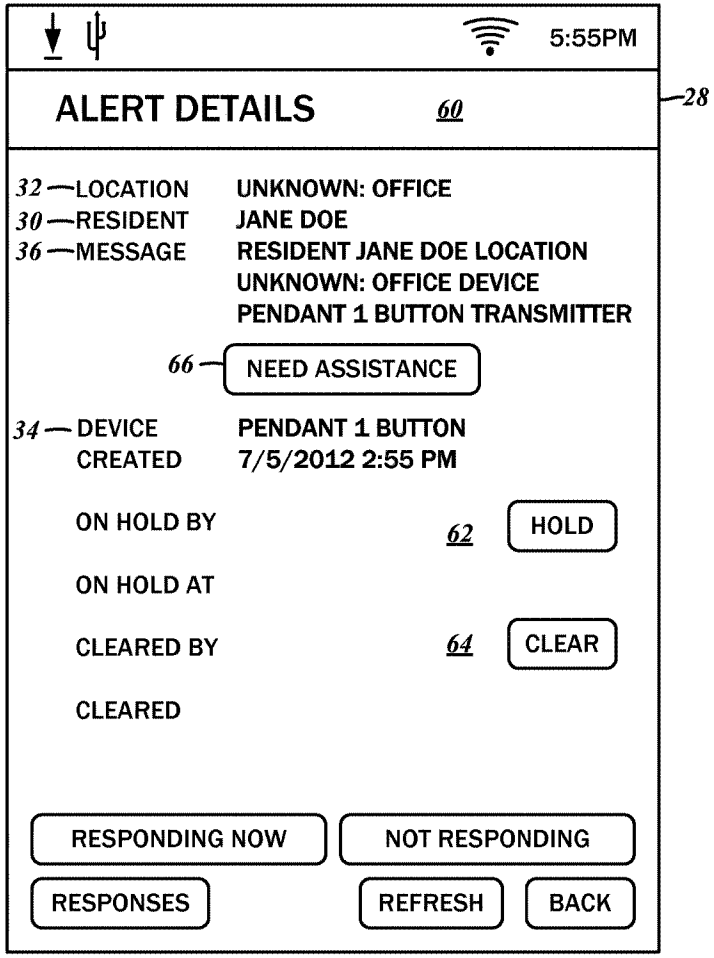

With reference to the screen captures of FIGS. 7A-7B, it is possible for one of the caregiver staff 22*a* to request help from the other caregiver staff 22*b-d*. From the notification screen 29 displayed in the user interface 28, a button 58 can be invoked. Although the details of the content of the notification screen 29 are different from that shown in FIG. 4, the structure of the identifiers shown is the same. In the illustrated example, the resident life safety device 16 is a wearable pendant that can act as a distress signaler. Upon selecting the button 58, labeled "More Info," an alert detail screen 60 is generated in the user interface 28. In addition to the same location identifier 32, the resident identifier 30, the message section 36, and the life safety device identifier 34, there may be an alert hold section 62 and an alert clear section 64. These are understood to add further levels of refinement to the action status response of holding the alert and clearing the alert, respectively.

Figure 7D:
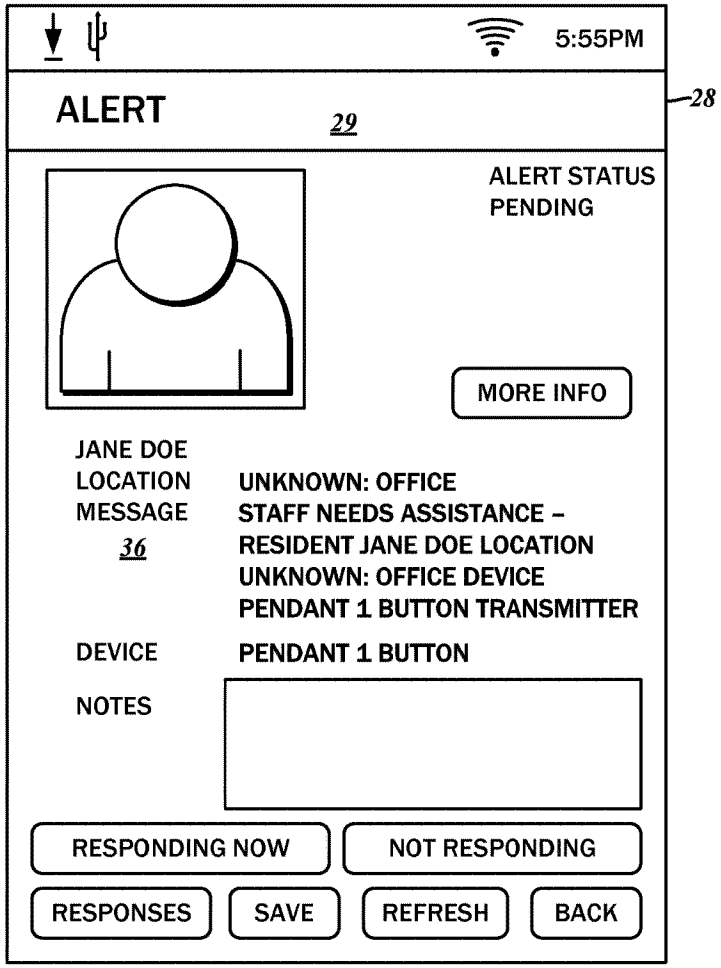
Figure 7C:
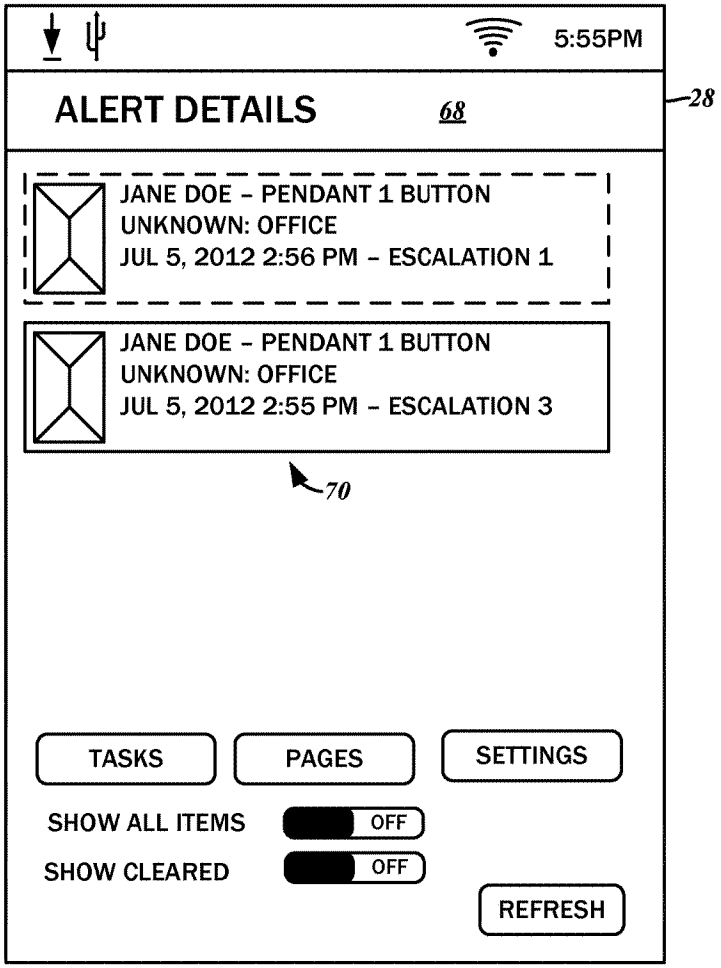

Also shown in the alert detail screen 60 is an assistance request button 66. Upon activation, a message is transmitted to the other caregiver communications devices 24, either through an intermediary of the central coordination server 18, or directly within the second network 26. Additionally, the action status response is modified to "hold." These alerts are displayed to the other caregiver staff 22 on the caregiver communications devices 24. FIG. 7C illustrates an example alert activity screen 68 presented to the non-originating caregiver staff 22. This screen may include a listing 70 of other active alerts, and its entries are understood to be interactive as well. That is, selecting an entry 70*a* may invoke another notification screen 29 as shown in FIG. 7D that corresponds to the request for assistance, and in the message section 36, is indicated thus. (E.g., that the staff needs assistance). The functions that can be accessed via this notification screen 29 are the same as those discussed above in relation to the notification screen 29 of FIG. 4. Upon clearing the alarm condition at the site of the resident life safety device 16, the central coordination server 18 can update the alarm notification and have the cleared status reflected amongst the caregiver communications devices 24.

Figure 8:
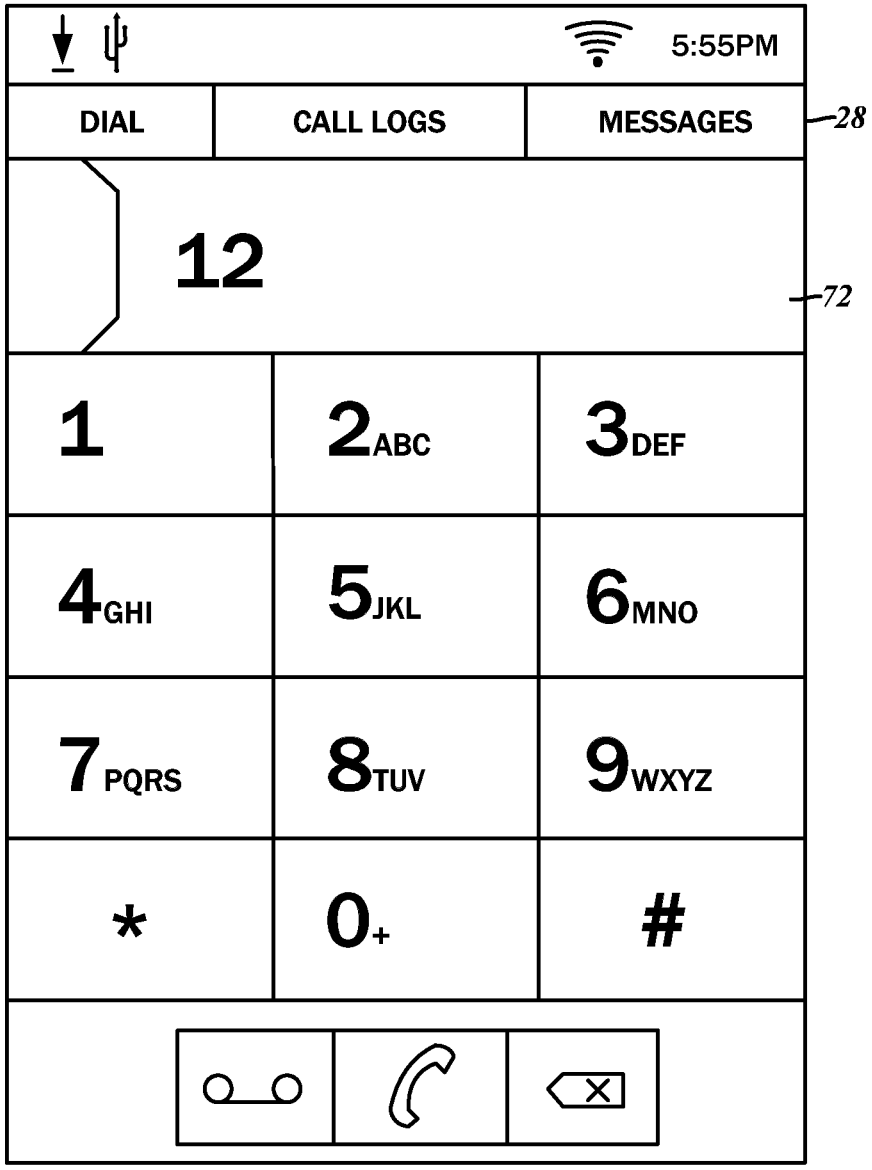
FIG. 8 is a screen capture of an example user interface for communicating with other caregiver communications devices.

There are additional modalities contemplated for communicating with other caregiver communications devices 24 of the interactive wireless life safety communications system 10. For instance, it is possible to have peer-to-peer communications with minimal involvement of the central coordination server 18. As shown in the screen capture of FIG. 8, number keypad 72 may be displayed on the user interface 28, with a number corresponding to the desired destination caregiver communications device 24 being input to establish a link therewith. Alternatively, it is possible for the user interface 28 to provide a listing of active caregiver communications devices 24, with the user being able to select one of those to which a connection request is initiated. Upon connecting to each other, the caregiver communications devices 24 may activate their respective microphones, with voice data being exchange much like a telephone or a radio. In according to one embodiment, this data traverses the second network 26. Instead of voice communications, text-based short messages can be exchanged amongst the caregiver staff 22 as well.

Beyond communicating with other local caregiver staff 22, the caregiver communication devices 24 can utilize a voice public branch exchange (PBX) network 23 to initiate telephone calls over telephone service 27. The central coordination server 18 includes a telephone line card 25 connected to the PBX 23 and to the telephone service 27. Utilizing the aforementioned user interface 28, the caregiver staff 22 may place 911 emergency calls and otherwise contact off-site personnel. Furthermore, it is possible to place calls to residents 14 at their listed telephone numbers from the caregiver communications device 24.

Figure 9:
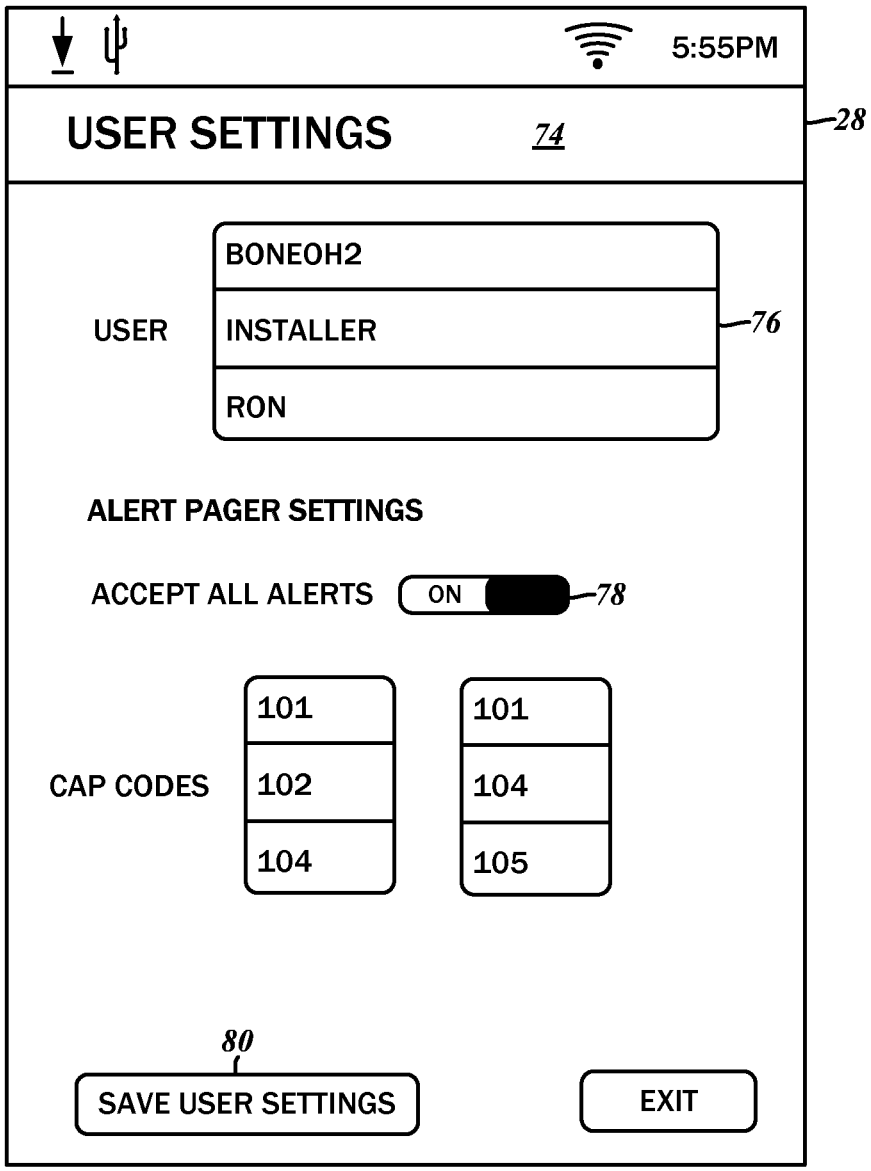
FIG. 9 is a screen capture of the user interface for assigning the caregiver communications device to a specific caregiver staff.

As mentioned above, the caregiver communications devices 24 are assigned to each individual caregiver staff 22. Preferably, though optionally, the caregiver communications devices 24 are stored and its batteries are being charged at the administrative center 17. The caregiver staff 22 check in with the administrative center 17 prior to each shift, and randomly picks up one of the caregiver communications devices 24. It is also possible to assign the caregiver communications device 24 to a specific caregiver staff 22 permanently. Referring to the screen capture of FIG. 9, the user interface 28 generates a device assignment screen 74. There is a caregiver listing 76 for selecting the identity to which the caregiver communications device 24 is to be assigned. Additional options including the availability to accept alerts can be set via an input switch 78. Once the identity is selected, a save button 80 can be actuated to record the identity with the central coordination server 18.

Because the caregiver communications device 24 are assigned to a specific caregiver staff, other administrative functions can be performed therewith. For example, staff-wide broadcast announcements can be transmitted from the central coordination server 18. Furthermore, staff check-ins while making rounds, staff timekeeping for logging working hours, etc. can also be processed and recorded. Being an interactive device with two-way communications capabilities, the caregiver communications device 24 can be used to submit maintenance requests, schedule housekeeping services, submit meal requests, and so forth directly on site. As such, the assisted care facility 1 can be much more responsive to the residents' needs.

Figure 10:
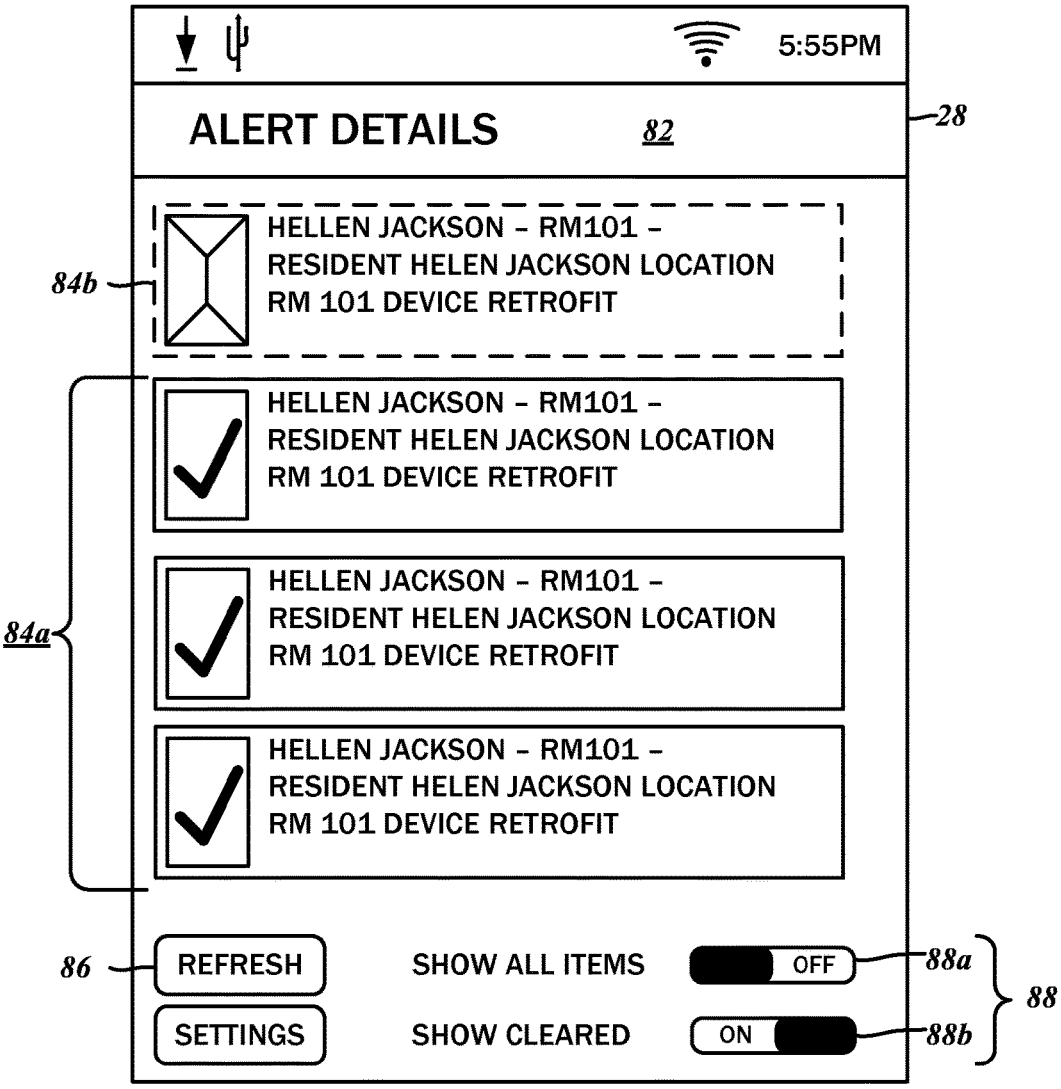
FIG. 10 is a screen capture of an example user interface to the central coordination server.

The alert notifications transmitted to the caregiver communications devices 24, as well as the action status responses from the caregiver communications devices 24, traverse the central coordination server 18 as discussed above. Accordingly, such data is stored and recorded near real-time monitoring by staff at the administrative center 17, and for subsequent review. Another caregiver communications device 24 may be used to access the central coordination server 18 to retrieve ongoing activity within the interactive wireless life safety communications system 10. As best shown in the screen capture of FIG. 10, the data is rendered in the user interface 28 as a supervisory screen 82, which includes a listing 84 of the most recent alert notifications issued by the central coordination server 18. The alert notifications to which the caregiver staff 22 responded **84*a* are shown highlighted in one color (e.g., green) while currently active alert notifications 84*b* are shown highlighted in a different color (e.g., red). Again, as with the other screens of the user interface 28 discussed above, it is possible to refresh the listing 86 via a refresh button. Which of the listings are shown in the supervisory screen 82 are selected via switches 88, including a first switch 88*a* for showing all alert notifications or not, and a second switch 88*b*** for showing cleared alert notifications or not. The time limit for showing all alert notifications may be limited to the last 24 hours, or any other arbitrary duration.

The central coordination server 18 is contemplated to generate and store various reports that may be categorized according to the specific resident 14, specific resident life safety devices 16 across the entire deployment in the assisted care facility 1, a specific resident life safety device 16 for a specific resident 14, and any other useful categorization that provides a meaningful view of the residents 14, the assisted care facility 1, and the caregiver staff 22. One exemplary report is illustrated in FIG. 11, which is a listing of alert notifications and responses generated for a specific resident 14, i.e., "John Smith."

The particulars shown herein are by way of example and for purposes of illustrative discussion of the embodiments of the present disclosure only and are presented in the cause of providing what is believed to be the most useful and readily understood description of the principles and conceptual aspects. In this regard, no attempt is made to show details of the present disclosure with more particularity than is necessary, the description taken with the drawings making apparent to those skilled in the art how the several forms of the present disclosure may be embodied in practice.

What is claimed is:

1. An interactive wireless life safety communications system comprising:

a first communications network;

a central coordination server linked to the first communications network;

at least one resident life safety device associated with one of a specific location within an assisted care facility and a specific resident thereof, the resident life safety device being connected to the central coordination server over the first communications network with an alarm signal generated upon detection of an alarm condition being transmitted to the central coordination server;

a second communications network different from the first communications network and linked to the central coordination server; and a plurality of caregiver communications devices, each of the plurality of caregiver communications devices associated with one of a plurality of caregiver identities and connected to the central coordination server over the second communications network, each of the plurality of caregiver communications devices being receptive to an alarm notification generated by the central coordination server and receptive to a caregiver user input;

wherein an action status response corresponding to one of a plurality of selectable responses to the alarm notification and including an identification of a responding caregiver is generated from the user input for transmission to the central coordination server over the second communications network;

wherein the plurality of selectable responses includes a selectable response indicating that the responding caregiver is responding to the alarm condition and a selectable response indicating that the responding caregiver is not responding to the alarm condition;

wherein, in response to a selection of the selectable response corresponding to the action status response indicating that the responding caregiver is responding to the alarm condition, all of the plurality of caregiver communications devices associated with the second communications network are automatically updated to indicate that the responding caregiver is responding to the alarm condition and the alarm notification remains active on all of the plurality of caregiver communications devices;

wherein, in response to a selection of the selectable response corresponding to the action status response indicating that the responding caregiver is not responding to the alarm condition, all of the plurality of caregiver communications devices associated with the second communications network are automatically updated to indicate that the responding caregiver is not responding to the alarm condition and the alarm notification remains active on all of the plurality of caregiver communications devices;

wherein, upon the alarm condition being cleared at the resident life safety device, the central coordination server updates all of the plurality of caregiver communications devices to indicate that the alarm condition is cleared;

wherein the central coordination server records the received action status response in association with the identification of the responding caregiver and the alarm notification to which the received action status response pertains.

2. The system of claim 1, wherein one of the resident life safety devices is one of a wireless pull cord, a wireless pendant, a wireless motion detector, a door alarm, a window alarm, a fall detector, a smoke detector, and an incontinence detector.

3. The system of claim 1, wherein the alarm notification to the plurality of caregiver communications devices is generated in response to the alarm signal.

4. The system of claim 1, wherein the alarm notification includes a one of a resident identifier, a graphical representation of a resident associated with the resident identifier, a location identifier corresponding to the one of the resident life safety devices from which the alarm signal was generated, and an alarm condition identifier corresponding to the one of the resident life safety devices from which the alarm signal was generated.

5. The system of claim 1, wherein the action status response includes a one of a response acceptance acknowledgement, a response declination acknowledgement.

6. The system of claim 1, wherein a first one of the plurality of caregiver communications devices is linkable to a second one of the plurality of caregiver communications devices over the second communications network, voice communications being exchangeable between the first and second one of the plurality of caregiver communications devices independently of the central coordination server.

7. The system of claim 1, wherein:

the first communications network is a hard-wired link; and the second communications network is wireless.

8. The system if claim 1, further comprising:

a private branch exchange communications module connected to the central coordination server, and linked to a telephone network;

wherein one of the plurality of the caregiver communications devices initiates a telephone call over the second communications network by accessing the private branch exchange communications module.

9. The system of claim 1, wherein the user input corresponds to an activation of a graphical user interface element displayed on each of the plurality of the caregiver communications devices.

10. The system of claim 1, wherein the user input corresponds to audio information received on each of the plurality of the caregiver communications devices.

11. The system of claim 1, wherein the user input corresponds to text information received on each of the plurality of the caregiver communications devices.

12. A method for coordinating caregiver responses to alert events in an assisted care facility, the method comprising the steps of:

generating an alarm signal upon detection of the alert event by a resident life safety device associated with one of a specific location within the assisted care facility and a specific resident of the assisted care facility;

transmitting the alarm signal from the resident life safety device to a central coordination server, the resident life safety device being connected to the central coordination server over a first communications network;

generating an alarm notification on the central coordination server in response to a receipt of the alarm signal;

transmitting the alarm notification to a plurality of caregiver communications devices, each of the plurality of caregiver communications devices associated with one of a plurality of caregiver identities, over a second communications network different from the first communications network;

receiving a caregiver input on each of the plurality of the caregiver communications devices, the caregiver input corresponding to an action status response corresponding to one of a plurality of selectable responses to the alarm notification and including an identification of a responding caregiver, the plurality of selectable responses including a selectable response indicating that the responding caregiver is responding to the alarm condition and a selectable response indicating that the responding caregiver is not responding to the alarm condition;

transmitting the action status response to the central coordination server over the second communications network;

in response to a selection of the selectable response corresponding to the action status response indicating that the responding caregiver is responding to the alarm condition, updating all of the plurality of caregiver communications devices associated with the second communications network to indicate that the responding caregiver is responding to the alarm condition while leaving the alarm notification active on all of the plurality of caregiver communications devices;

in response to a selection of the selectable response corresponding to the action status response indicating that the responding caregiver is not responding to the alarm condition, updating all of the plurality of caregiver communications devices associated with the second communications network to indicate that the responding caregiver is not responding to the alarm condition while leaving the alarm notification active on all of the plurality of caregiver communications devices;

upon the alarm condition being cleared at the resident life safety device, updating all of the plurality of caregiver communications devices to indicate that the alarm condition is cleared; and recording the received action status response in association with the identification of the responding caregiver and the alarm notification to which the received action status response pertains.

13. The method of claim 12, wherein one of the resident life safety devices is one of a wireless pull cord, a wireless pendant, a wireless motion detector, a door alarm, a window alarm, a fall detector, a smoke detector, and an incontinence detector.

14. The method of claim 12, wherein the alarm notification includes a one of a resident identifier, a graphical representation of a resident associated with the resident identifier, a location identifier corresponding to the one of the resident life safety devices from which the alarm signal was generated, and an alarm condition identifier corresponding to the one of the resident life safety devices from which the alarm signal was generated.

15. The method of claim 12, wherein the action status response includes a one of a response acceptance acknowledgement, a response declination acknowledgement.

16. A method for coordinating caregiver responses to alert events in an assisted care facility, the method comprising the steps of:

receiving on the central coordination server an alarm signal from a resident life safety device associated with one of a specific location within the assisted care facility and a specific resident of the assisted care facility, the alarm signal corresponding to the alert event as detected by the resident life safety device;

generating an alarm notification on the central coordination server in response to the received alarm signal;

transmitting the alarm notification to a plurality of caregiver communications devices, each of the plurality of caregiver communications devices associated with a specific caregiver identity;

receiving an action status response from a first one of the plurality of caregiver communications device, the action status response corresponding to one of a plurality of selectable responses by a caregiver to the transmitted alarm notification and including an identification of the caregiver providing the action status response, the plurality of selectable responses including a selectable response indicating that the responding caregiver is responding to the alarm condition and a selectable response indicating that the responding caregiver is not responding to the alarm condition;

in response to a selection of the selectable response corresponding to the action status response indicating that the responding caregiver is responding to the alarm condition, updating all of the plurality of caregiver communications devices to indicate that the responding caregiver is responding to the alarm condition while leaving the alarm notification active on all of the plurality of caregiver communications devices;

in response to a selection of the selectable response corresponding to the action status response indicating that the responding caregiver is not responding to the alarm condition, updating all of the plurality of caregiver communications devices to indicate that the responding caregiver is not responding to the alarm condition while leaving the alarm notification active on all of the plurality of caregiver communications devices;

upon the alarm condition being cleared at the resident life safety device, updating all of the plurality of caregiver communications devices to indicate that the alarm condition is cleared; and recording the received action status response in association with the identification of the responding caregiver and the alarm notification to which the received action status response pertains.

17. The method of claim 16, further comprising:

transmitting an action status update to at least one caregiver communications device in response to the received action status from the first one of the at least one caregiver communications device.

18. The method of claim 16, further comprising:

assigning each of the plurality of caregiver communication devices to one of a plurality of caregivers, the action status response transmitted from each of the plurality of caregiver communication devices being linked to a caregiver identity of one of the plurality of caregivers to whom the one of the plurality of caregiver communication devices is assigned on the central coordination server.

19. The method of claim 16, wherein one of the resident life safety devices is one of a wireless pull cord, a wireless pendant, a wireless motion detector, a door alarm, a window alarm, a fall detector, a smoke detector, and an incontinence detector.

20. The method of claim, 16 wherein the alarm notification includes a one of a resident identifier, a graphical representation of a resident associated with the resident identifier, a location identifier corresponding to the one of the resident life safety devices from which the alarm signal was generated, and an alarm condition identifier corresponding to the one of the resident life safety devices from which the alarm signal was generated.

21. A computing device comprising a display screen with icons, the computing device being configured to display on the screen a menu including one or more communication modalities enabling both one way and two way communication, and additionally being configured to display on the screen a messaging suite that can be reach directly from the menu, wherein the messaging suite selectably includes both text and voice communication, both the text and voice communication operable in a two way mode, and the menu further including scrolling functionality, one or more buttons receptive to a caregiver user input to designate a response status corresponding to one of a plurality of selectable responses to an alarm notification including a selectable response indicating that the caregiver is responding to an alarm condition and a selectable response indicating that the caregiver is not responding to the alarm condition, and a direct access to a response list, the response list displaying all of a plurality of caregivers, each of the plurality of caregivers displayed along with the response status corresponding to that caregiver, the alarm notification remaining active on the display screen of the computing device independent of the response statuses of the plurality of caregivers.

22. The computing device of claim 21, wherein the two way communication is between the computing device and another computing device operated by one of the plurality of caregivers.

23. The computing device of claim 21, the menu further including a display of data including a resident name, location, and device generating an alert.

24. The computing device of claim 21, the menu further including a link for more information, the link for more information including a call button for additional assistance, the call button being operated by a single touch.

25. The computing device of claim 23, the menu further including a graphical representation of an image of the resident.

26. The computing device of claim 21, the menu further including a button associated with the alarm notification that invokes a response details screen including the response list.

* * * * *